US005997149A

United States Patent [19]

Chu

[11] Patent Number: 5,997,149

[45] Date of Patent: Dec. 7, 1999

[54] REVERSIBLE BACKLIT PERSONAL GROOMING MIRROR

[75] Inventor: Chia-Wu Chu, Tung Shih, Taiwan

[73] Assignee: Manica Taiwan, Inc., Taiwan

[21] Appl. No.: 09/052,110

[22] Filed: Mar. 31, 1998

[51] Int. Cl.[6] ..... F21V 33/00

[52] U.S. Cl. ..... 362/142; 362/294; 362/802

[58] Field of Search ..... 362/135, 136, 362/137, 142, 144, 294, 802, 345, 492, 395, 394

[56] References Cited

U.S. PATENT DOCUMENTS

| | | | |
|---|---|---|---|
| D. 112,432 | 12/1938 | Bohn . | |
| D. 157,236 | 2/1950 | Brozyna . | |
| D. 163,481 | 5/1951 | Rauh . | |
| D. 176,750 | 1/1956 | Brozyna . | |
| D. 204,858 | 5/1966 | Rothman . | |
| D. 225,476 | 12/1972 | Pavenick . | |
| D. 226,248 | 1/1973 | Krusche . | |
| D. 228,422 | 9/1973 | Stahl . | |
| D. 252,366 | 7/1979 | Cohen . | |
| D. 253,429 | 11/1979 | Tomaro . | |
| D. 253,728 | 12/1979 | Anderson . | |
| D. 254,645 | 4/1980 | Wachtel . | |
| D. 254,830 | 4/1980 | Wachtel . | |
| D. 258,017 | 1/1981 | Steinkamp . | |
| D. 258,694 | 3/1981 | deHaseth . | |
| D. 258,842 | 4/1981 | deHaseth . | |
| D. 334,667 | 4/1993 | Lonczak et al. . | |
| D. 379,125 | 5/1997 | Simjian . | |
| 1,138,552 | 5/1915 | Goddard . | |
| 1,157,519 | 10/1915 | Fagan . | |
| 1,451,017 | 4/1923 | Franklin et al. . | |
| 1,593,246 | 7/1926 | De Haven . | |
| 1,667,545 | 4/1928 | Goddard . | |
| 1,761,393 | 6/1930 | Hoegger . | |
| 1,979,542 | 11/1934 | Hauser et al. . | |
| 2,180,151 | 11/1939 | Koeller . | |
| 2,200,114 | 5/1940 | Konikoff | 362/144 |
| 2,286,247 | 6/1942 | Yearta . | |
| 3,268,715 | 8/1966 | Rothman . | |
| 3,378,679 | 4/1968 | Trudeau . | |
| 3,591,792 | 7/1971 | Soltan | 362/144 |
| 3,641,334 | 2/1972 | Kipping . | |
| 3,824,001 | 7/1974 | Rosenberg . | |
| 4,164,823 | 8/1979 | Marsico . | |
| 4,824,159 | 4/1989 | Fluharty | 362/492 |
| 5,331,518 | 7/1994 | Roark | 362/492 |
| 5,453,915 | 9/1995 | Bradley, III . | |

*Primary Examiner*—Stephen Husar
*Assistant Examiner*—Hargobind S. Sawhney
*Attorney, Agent, or Firm*—David M. Quinlan

[57] ABSTRACT

A reversible, backlit grooming mirror has a planar mirror and a concave mirror mounted back-to-back in a reflector unit in parallel relation, with a space between the mirrors. The reflector unit is mounted for rotation in a mirror frame between a first position presenting the planar mirror to a user and a second position presenting the concave mirror to the user. A light source such as a halogen lamp is disposed in the space between the mirrors. A switch responsive to rotation of the reflector unit terminates electrical power to the lamp unless the reflector unit occupies a position in which one of the mirrors is in an operative position before the user.

12 Claims, 2 Drawing Sheets

REVERSIBLE BACKLIT PERSONAL GROOMING MIRROR

BACKGROUND OF THE INVENTION

1. Field of the Invention

The present invention relates to a grooming mirror, and more particularly, to a grooming mirror with multiple backlit reflecting surfaces.

2. Description of Related Technology

Mirrors with multiple reflecting surfaces, one of which is typically planar and the other of which is concave to provide magnification, are known to be particularly well-suited for personal grooming tasks such as applying makeup or shaving. There are many types of such mirrors, examples being disclosed in U.S. Pat. No. 2,200,114, U.S. Pat. No. 3,268,715, U.S. Pat. No. 3,378,679, U.S. Pat. No. 3,824,001 and U.S. Pat. No. 5,453,915, and U.S. Design Pat. No. 258,017.

Most of the mirrors disclosed in those patents are illuminated, another feature that is especially useful for tasks that require good lighting of the face of the person using the mirror. Placing a light source behind the mirror and having light shine on the user's face from the periphery of the mirror's reflecting surface is one desirable way of providing such illumination. That type of arrangement is shown in U.S. Pat. No. 1,138,552, U.S. Pat. No. 2,180,151, U.S. Pat. No. 2,200,114, U.S. Pat. No. 3,378,679 and U.S. Pat. No. 3,641,334.

However, prior art approaches to backlighting multiple-sided mirrors have certain drawbacks. For example, the arrangement in U.S. Pat. No. 2,200,114 requires the user to tilt the mirror out of a reflector housing, rotate it to expose the mirror's reverse side, and then tilt the mirror back into the reflector housing. Among the problems with this approach is that it completely exposes the inside of the reflector housing to the user, which is undesirable from a marketing standpoint, and it requires that the mirror tilt be reset each time the reflecting surface is changed, thus inconveniencing the user.

In U.S. Pat. No. 3,378,679 the two mirrors are on opposite sides of a lamp shade type member mounted on a light bulb by a wire spring clamp having opposing arms that engage the glass envelope of the light bulb in a manner similar to a conventional lamp shade. This arrangement makes it even more inconvenient for the user to change the reflecting surface, since the shade member must be grasped and rotated about the light bulb. Among other problems, the shade member may be too hot to grasp, the light bulb is subject to breakage and the tilt of the mirror will be disturbed when the shade member is rotated.

Heretofore there has been no known solution to these problems with prior art backlit mirrors having multiple reflecting surfaces.

SUMMARY OF THE INVENTION

It is an object of the present invention to provide a lighted mirror with multiple reflecting surfaces that overcomes the problems associated with the prior art.

It is another object of the present invention to provide a mirror assembly comprising a mirror frame, a first reflector having a first reflecting surface, a second reflector having a second reflecting surface, the first reflecting surface and second reflecting surface being attached together to form a reflector unit having a space bounded on two sides by the first reflecting surface and the second reflecting surface, wherein the reflector unit is mounted to the mirror frame for rotation between a first position presenting the first reflecting surface to a user and a second position presenting the second reflecting surface to the user, a light source disposed in the space, and a switch responsive to rotation of the reflector unit for terminating power to the light source unless the reflector unit occupies one of the first position and second position.

In a particular preferred embodiment, a mirror assembly comprises a mirror base, a mirror frame mounted to the mirror base at opposed pivot points for rotation about a substantially horizontal axis, a reflector unit comprising a first mirror having a planar reflecting surface and a second mirror having a concave reflecting surface, the first mirror and the second mirror being attached together back-to-back in parallel relation to form a space therebetween, a stub shaft and a post assembly at opposing ends of a vertical axis for mounting the reflector unit to the mirror frame for rotation, the mirror frame including a bearing accepting the post assembly therein, a lamp disposed in the space, wherein the mirror frame includes a reflector at a periphery thereof for reflecting toward a user of the mirror assembly light from the lamp escaping the space at the periphery thereof and a diffuser lens for diffusing the reflected light before it reaches the user, switch means for terminating electrical power to the lamp unless the reflector unit is in one of a first position wherein the first mirror is facing the user or a second position wherein the second mirror is facing the user, the switch means comprising one contact within the post assembly and another contact in the bearing, and detent means for holding the reflector unit in one of the first and second positions.

BRIEF DESCRIPTION OF THE DRAWINGS

The objects of the invention will be better understood from the detailed description of its preferred embodiments which follows below, when taken in conjunction with the accompanying drawings, in which like numerals refer to like features throughout. The following is a brief identification of the drawing figures used in the accompanying detailed description.

DETAILED DESCRIPTION OF PREFERRED EMBODIMENTS

Figure 1:
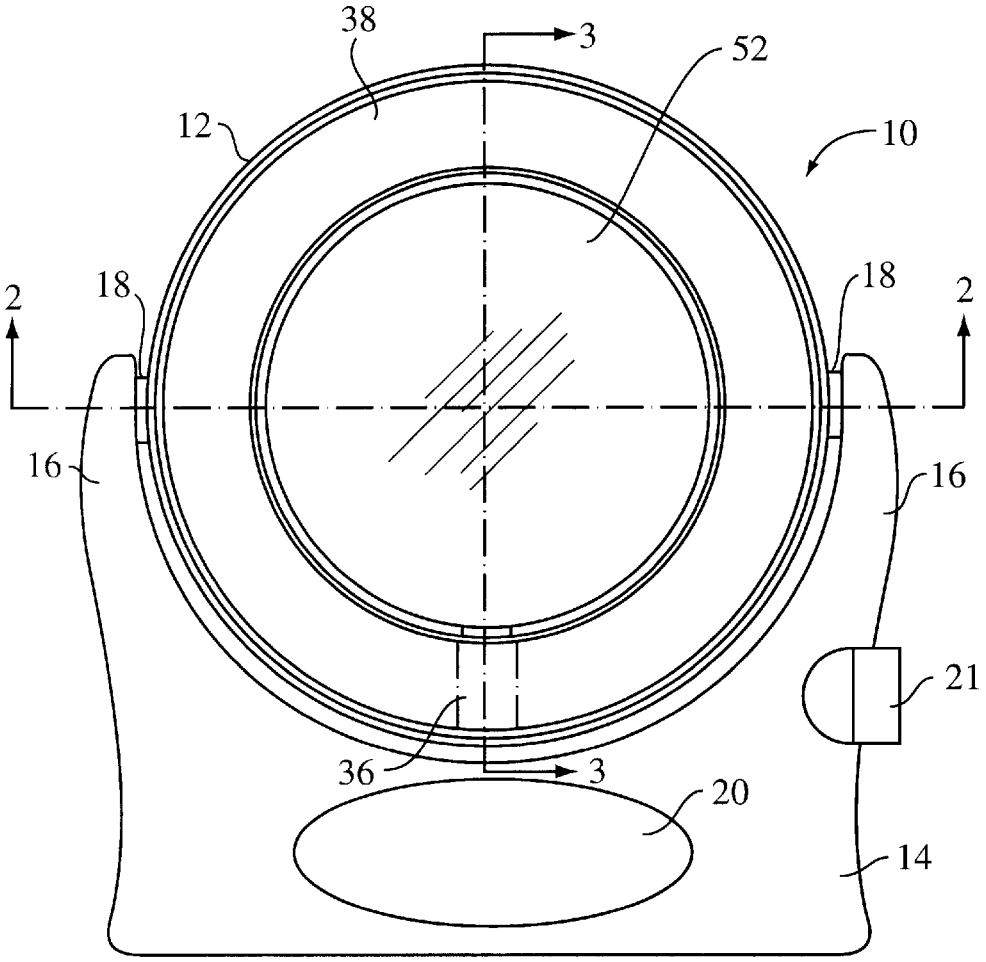
FIG. 1 is a front elevation view of a grooming mirror in accordance with one embodiment of the present invention.

Referring to FIG. 1, a grooming mirror 10 in accordance with one embodiment of the invention includes a generally circular mirror frame 12 mounted to a mirror base 14. The base 14 has a flat bottom for resting on a surface such as a dressing table, but it is within the scope of the invention to provide a mirror base adapted to be secured to a wall, which might be more convenient if the mirror 10 is to be used as a shaving accessory.

The mirror base 14 includes upstanding arms 16 that terminate just above the horizontal diameter of the mirror frame and include pivot points 18 that mount the mirror frame so that it can be pivoted about a horizontal axis. (Directional or positional terms such as "horizontal,"

"above" and the like are used herein for convenience in describing the depicted embodiment of the invention. Those terms refer to the normal orientation of the described mirror when it is being used, and employment herein of such terms should not be taken as limiting the invention in any way. By pivoting the mirror frame about the horizontal axis provided by the pivot points 18, the user can impart a desired tilt to the mirror frame 12 to bring his or her face into view. The base 14 may also include a drawer 20 for holding grooming articles, such as cosmetics or shaving accessories. A main control 21 includes the necessary components to enable the user to control the lamp within the mirror (as described below), allowing it to be turned on and off, as well as controlling its illuminating characteristics such as its intensity and the like.

Figure 2:
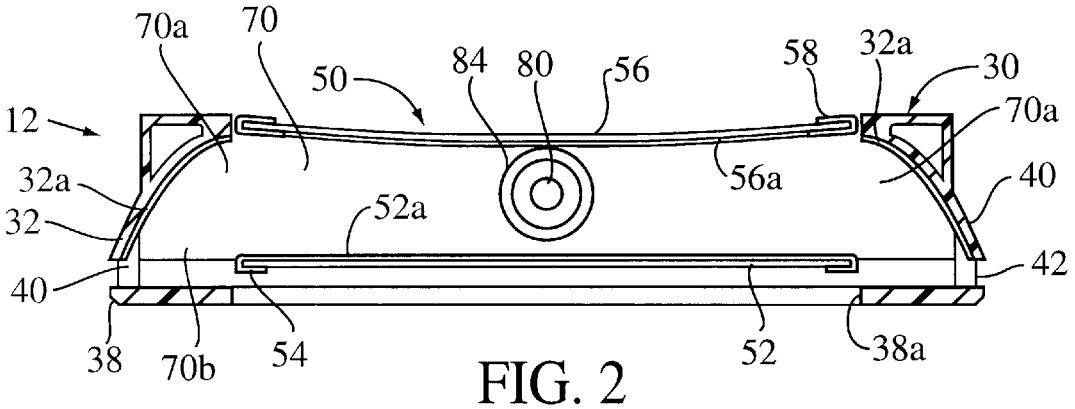
FIG. 2 is a sectional view taken along line 2—2 of FIG. 1 showing the relation of the mirror frame and the reflector unit of the grooming mirror.
Figure 4:
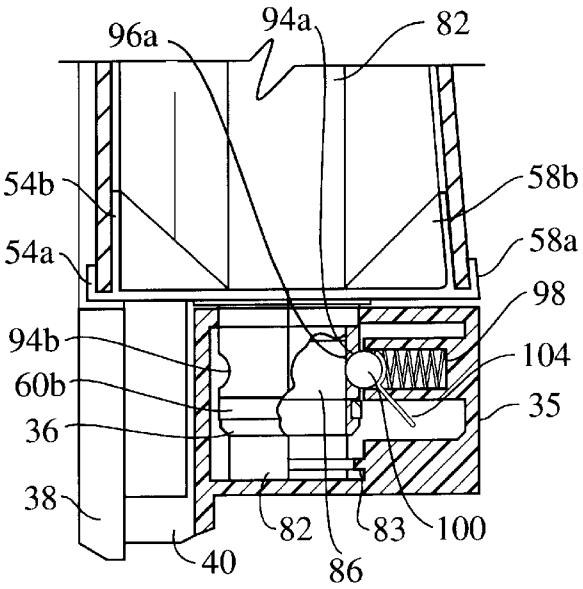
FIG. 4 is a view of detail 4—4 in FIG. 3.
Figure 3:
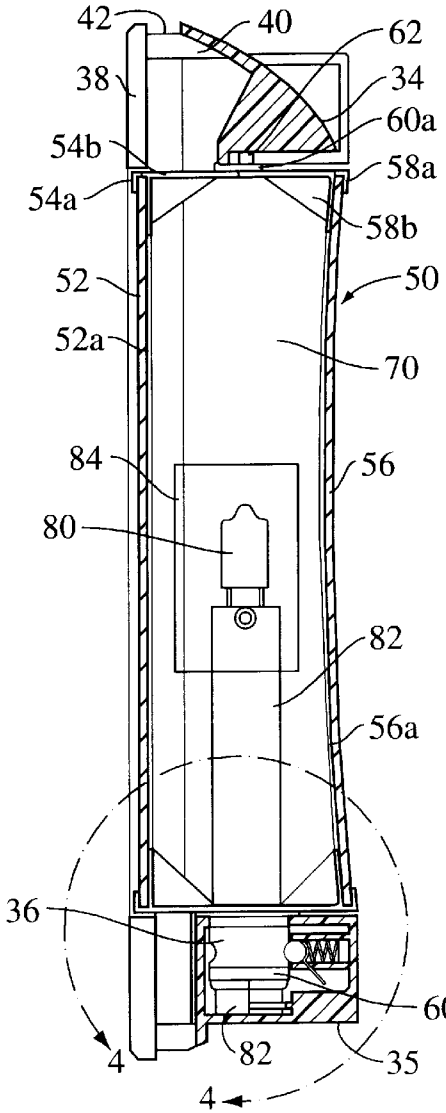
FIG. 3 is a sectional view taken along line 3—3 of FIG. 1 illustrating details of the reflector unit and its mounting to the mirror frame.

The mirror frame 12 is shown in more detail in FIGS. 2 to 4 (from which the mirror base is omitted for clarity). The mirror frame 12 includes a structural body 30 that is molded from a suitable plastic material and has sufficient strength to support the components of the mirror frame and reflector unit (described in detail below). The frame body 30 is generally annular, and its peripheral portion 32 has a predetermined shape for a purpose described below. An annular diffuser lens 38 is mounted to the frame body 30 on arms 40 spaced at intervals around the periphery of the frame body. The arms 40 establish an gap 42 between the lens 38 and the frame body 30 at the periphery of the outside surface of the frame body.

A reflector unit 50 is mounted at the top and bottom for rotation within the frame body 30. This is seen more clearly in FIG. 3, which shows a reinforced boss 34 at the top of the frame body 30 and a bearing assembly 35 at the bottom of the frame body 30. The reflector unit 50 includes at the top end of a vertical diameter a stub axle 62, and at an opposite end of the same vertical diameter a post assembly 36. The stub axle 62 and the post assembly 36 are mounted for rotation in the reinforced boss 34 and the bearing assembly 35, respectively.

The reflector unit 50 includes a first reflector and a second reflector. The first reflector comprises a conventional planar mirror 52 held in a suitable annular mirror mount 54. The second reflector comprises a second mirror 56 that is generally planar but has a conventional, slightly concave, and thus magnifying, reflecting surface. The mirror 56 is also in held a suitable annular mirror mount 58.

The mirror mount 54 includes a front bezel 54*a* and a rear bezel 54*b*. The planar mirror 52 is captured between the bezels 54*a* and 54*b*, which are then secured together by any suitable technique, such as ultrasonic welding. The mirror mount 58 includes similar front and rear bezels 58*a* and 58*b*, which are similarly secured together with the concave mirror 56 between them. The rear bezels 54*b* and 58*b* each include half of the stub axle 62 and of the post assembly 36. The mirror mounts 54 and 58 are secured together to form the reflector unit 50 with the mirrors mounted together in generally parallel, back-to-back relation with their reflecting surfaces facing outwardly and a space 70 formed between them. In the present embodiment the mirror mounts 54 and 58 are secured together by fastener rings 60*a* and 60*b* that encircle the stub axle 62 and post assembly 36, respectively.

The mirrors 52 and 56 have reflective metallic polyester films 52*a* and 56*a* adhered to their inner surfaces that face each other. The peripheral portion 32 of the mirror frame 30 also has a reflective metallic polyester film 32*a* adhered to its inner surface.

A light source is disposed in the space 70. The light source is preferably a halogen lamp 80, which can provide different colors depending on the voltage supplied thereto. This is advantageous for a makeup mirror because it enables the user to simulate the lighting conditions expected to be encountered while wearing the makeup being applied (for example, daylight, candlelight, incandescent light, etc.). If different voltages are to be provided to the light source, the mirror will include a transformer (not shown), most conveniently located in the mirror base 14. The lamp 80 is controlled by the user through the main control 21 (see FIG. 1).

The halogen lamp 80 is mounted on a lamp post 82, which has wiring internally thereof to supply the lamp with the requisite electrical power for operation. An annealed glass tube 84 is mounted to the lamp post 82 and surrounds the halogen lamp 80 for added safety. Electrical power for the lamp 80 is provided to the wiring in the lamp post through the post assembly 36 in a manner to be described. The lamp post 82 is rigidly connected to the mirror frame body 30 by a suitable arrangement, such as the set screw 83 depicted schematically in the figures.

The light emitted by the lamp 80 is reflected by the internal surface of the peripheral portion 32 of the mirror frame 12 and thus through the lens 38. The framing structure of the reflector unit 50 is configured to minimize any obstruction of light from the lamp 80 to the open periphery 70*a* of the space 70 and through the opening 70*b* in the front of the frame 12 (see FIG. 2). Accordingly, light rays from the lamp have a relatively unobstructed path to the reflective inner surface of the peripheral portion 32 of the mirror frame.

The reflective films 52*a* and 56*a* on the inside of the mirrors 52 and 56 provide internal reflection that maximizes the amount of light reaching the portion 32 and reflects radiant heat from the lamp to prevent overheating of the mirrors. The peripheral portion 32 is shaped to direct the light impinging on it from between the mirrors 52 and 56 in generally parallel rays toward the lens 38, and the lens diffuses the light before it reaches the user's eyes. Those skilled in the art will be able to properly construct the peripheral portion to maximize the light directed toward the lens 38, and also to provide an appropriate lens properly to diffuse the light passing therethrough.

An important feature of the invention resides in the switch formed as part of the bearing assembly 35 and the post assembly 36, seen in detail in FIG. 4. The mirror frame body 30 is molded with an enlarged portion at its bottom that accepts and forms a bearing for the post assembly 36 for rotation about a vertical axis passing through the stub axle 62 at the top of the mirror frame. The post assembly 36 is hollow and accepts therethrough the lamp post 82. A metal sheath 86 on the surface of the lamp post 82 within the hollow post assembly 36 is connected to the wiring for the lamp 80. The post assembly includes two diametrically opposed spherical recesses 94*a* and 94*b*. Each spherical recess has an aperture through which the metal sheath is exposed externally of the post assembly 36. Only one aperture 96*a* is shown in FIG. 4.

The bearing assembly 35 of the mirror frame includes a blind hole 98 that has a steel ball 100 at its open end. The ball 100 is biased outwardly by a compression spring 102. An electrical contact 104 is connected to the steel ball. The steel ball is accepted into the spherical recesses 94*a* and 94*b* and partially enters the apertures at the bottom of the recesses. Thus, as the reflector unit 50 is rotated by the user about the vertical axis provided by the stub axle 62 and the post assembly 36, the steel ball 100 contacts the sheath 86 through the apertures when the reflector unit 50 is in one of two predetermined positions. The contact 104 is connected to wiring (not shown) from the transformer in the base 14. Most conveniently, the wiring from the transformer is passed through one of the pivot points 18, which is made hollow for the purpose of permitting such wiring to pass therethrough, and is led to the lamp post 82 internally of the mirror frame 12. The wiring forms an electrical circuit with the switch thus formed by the steel ball 100 and the post assembly 36 connected in series with the lamp 80.

In operation, the user adjusts the tilt of the mirror frame 12 about the pivot points 18 to comfortably bring his or her face into view in one of the mirrors 52 or 56. When the reflector unit is in the position shown in FIGS. 2 and 3, the edges of the planar mirror 52 fit within the central opening 38*a* provided by the annular lens 38, while the edges of the concave mirror 56 are generally flush with the edges 30*a* and 30*b* of the back of the mirror frame body 30. Electrical power is provided to the lamp 80 by virtue of the contact between the ball 100 and the metal sheath 86 through the aperture 96*a* in the hollow post assembly 36. Light from the lamp 80 passes through the space 70*a* around the periphery of the reflector unit 50, and is reflected by the peripheral portion 32 of the mirror frame 30, through the diffusing lens 38, and the face of the user. The gap 42 established by the arms 40 provides a ventilation space to enhance the circulation of air around the lens 38 and in the space formed by the peripheral portion 32 of the mirror frame. This inhibits heat build-up in the mirror parts.

If the user wants to use the magnifying properties of the concave mirror 56, he or she rotates the reflector unit 50 about the vertical axis provided by the stub shaft 62 and the post assembly 36. When the reflector unit is rotated, the ball 100 is cammed out of the aperture 96*a* and is maintained out of contact with the sheath 86. This breaks the electrical contact between the ball 100 and the sheath 86, thus terminating power to and extinguishing the lamp 80 as the reflector unit is rotated. When the concave mirror 56 reaches the location formerly occupied by the planar mirror 52, the ball enters the aperture at the spherical recess 96, thus relighting the lamp 80. Accordingly, the user is not exposed to the bright light emitted by the lamp 80 when the reflecting unit 50 is in an operative position, and the tilt of the reflecting unit is not disturbed while the user changes between a magnifying mirror and a planar mirror.

The rotation of the reflector unit 50 about the vertical axis provided by the stub axle 62 and the post assembly 36 has a smooth feel to the user by virtue of the ball 100 riding over the post assembly 36. The cooperation of the ball 100 and the spherical recesses 96 and 96 provides a detent mechanism that holds the reflector unit in place in its first and second operative positions (that is, the positions in which one of the mirrors 52 or 56 is facing the user and the lamp 80 is energized).

Another advantage of the present invention is that the internal structure of the mirror is largely maintained hidden from view at all times, even when the reflecting surface is being changed. Although the interior of the reflector unit 50 is theoretically visible as it is rotated, the space 70 is small enough that without illumination a user cannot actually see into it, especially considering that the mirrors themselves are opaque, so that the space 70 will be fairly dark when not illuminated, and the user's eyes will not have time to accommodate to the lower level of illumination while the reflector unit is rotated because the lamp 80 has just been extinguished. In any event, the opening 70*a* can also be covered with a translucent material that passes a large amount of light, but prevents the user from actually seeing into the space 70 when the lamp 80 is not on. In addition, the wiring from the base 14 to the sheath 86 can be concealed in the mirror frame so that it is not visible to the user when the reflector unit is rotated.

It should also be appreciated that the switch described above, which is responsive to rotation of the reflector unit for terminating power to the lamp unless the reflector unit occupies either of a first or second position, can be modified without departing from the present invention. The switch arrangement described herein is the one believed at present to best accomplish the function of such switch, but other suitable switch structure may be possible.

Although preferred embodiments of the invention have been depicted and described, it will be understood that various modifications and changes can be made other than those specifically mentioned above without departing from the spirit and scope of the invention, which is defined solely by the claims that follow.

What is claimed is:

1. A mirror assembly comprising:

a mirror frame;

a first reflector having a first reflecting surface;

a second reflector having a second reflecting surface, said first reflecting surface and said second reflecting surface being attached together to form a reflector unit having a space bounded on two sides by said first reflecting surface and said second reflecting surface, wherein said reflector unit is mounted to said mirror frame for rotation between a first position presenting said first reflecting surface to a user and a second position presenting said second reflecting surface to the user;

a light source disposed in said space; and a switch responsive to rotation of said reflector unit for terminating power to said light source unless said reflector unit occupies one of said first position and said second position.

2. A mirror assembly as in claim 1, wherein:

said first reflector and said second reflector are substantially planar and disposed with said first reflecting surface parallel to said second reflecting surface;

said space is open at the periphery thereof for permitting light from said light source to escape said space; and said mirror frame includes a peripheral reflector disposed at the periphery of said space for reflecting the light from said space toward the user.

3. A mirror assembly as in claim 2, wherein said first reflecting surface is planar and said second reflecting surface is concave.

4. A mirror assembly as in claim 2, wherein said mirror frame further includes:

an opening for permitting light reflected by said peripheral reflector to illuminate the user; and a diffuser lens in said opening for diffusing the light passing through said opening, said diffuser lens being mounted to said mirror frame to provide a ventilation space between said diffuser lens and said mirror frame.

5. A mirror assembly as in claim 3, wherein:

said reflector unit is mounted to said mirror frame by a post for permitting rotation of the mirror frame about a substantially vertical axis; and said switch comprises cooperating contacts in said post.

6. A mirror assembly as in claim 4, further comprising a mirror base, wherein said mirror frame is mounted on said mirror base at pivot points for permitting rotation of said mirror frame about a substantially horizontal axis.

7. A mirror assembly as in claim 4, wherein:

said reflector unit includes said post;

said post includes a hollow cylinder mounted in a bearing in said mirror frame, said post having apertures therein at circumferential locations corresponding to said first and said second positions of said reflector unit; and said switch includes a metal ball in said bearing and a metal sheath inside said post, wherein said ball contacts said sheath through said apertures to establish electrical contact therewith.

8. A mirror assembly as in claim 2, wherein said first reflector and said second reflector have rear surfaces in facing relation with each other, said facing surfaces being reflective.

9. A mirror assembly as in claim 7, wherein said light source is a halogen lamp and said rear surfaces have reflective foil thereon for reflecting light and radiant heat from said lamp.

10. A mirror assembly comprising:

a mirror base;

a mirror frame mounted to said mirror base at opposed pivot points for rotation about a substantially horizontal axis;

a reflector unit comprising a first mirror having a planar reflecting surface and a second mirror having a concave reflecting surface, said first mirror and said second mirror being attached together back-to-back in parallel relation to form a space therebetween;

a stub shaft and a post assembly at opposing ends of a vertical axis for mounting said reflector unit to said mirror frame for rotation, said mirror frame including a bearing accepting said post assembly therein;

a lamp disposed in said space, wherein said mirror frame includes a reflector at a periphery thereof for reflecting toward a user of said mirror assembly light from said lamp escaping said space at the periphery thereof and a diffuser lens for diffusing the reflected light before it reaches the user;

switch means for terminating electrical power to said lamp unless said reflector unit is in one of a first position wherein said first mirror is facing said user or a second position wherein said second mirror is facing said user, said switch means comprising one contact within said post assembly and another contact in said bearing; and detent means for holding said reflector unit in one of said first and second positions.

11. A mirror assembly as in claim 10, wherein said switch means includes a ball in said bearing and a metal sheath within said post assembly, said metal sheath being contacted by said ball through apertures in said post assembly at locations thereof corresponding to said first and second positions of said reflector unit, said ball being spring biased into contact with said post assembly to form said detent means.

12. A mirror assembly as in claim 10, wherein said mirror base includes a flat bottom for resting on a surface to orient said pivot points substantially horizontally.

* * * * *

UNITED STATES PATENT AND TRADEMARK OFFICE

CERTIFICATE OF CORRECTION

PATENT NO : 5,997,149

DATED : December 7, 1999

INVENTOR(S) : Chia-Wu Chu

It is certified that error appears in the above-identified patent and that said Letters Patent is hereby corrected as shown below:

Claim 5

Line 1, "3" should read --4--.

Claim 6

Line 1, "4" should read --5--.

Claim 7

Line 1, "4" should read --5--.

Claim 9

Line 1, "7" should read --8--.

Signed and Sealed this

Eighth Day of August, 2000

*Attest:*

*Attesting Officer*

Q. TODD DICKINSON

*Director of Patents and Trademarks*